US006055698A

United States Patent [19]

De Guzman

[11] Patent Number: 6,055,698

[45] Date of Patent: May 2, 2000

[54] WRINGER, WEB SUPPORT AND WEB

[75] Inventor: Joselito De Guzman, Redondo Beach, Calif.

[73] Assignee: Micronova Manufacturing Inc., Torrance, Calif.

[21] Appl. No.: 09/085,383

[22] Filed: May 26, 1998

[51] Int. Cl.[7] ..... A47L 13/58

[52] U.S. Cl. ..... 15/260; 68/242; 100/122; 100/132; 242/532.6; 242/587.2

[58] Field of Search ..... 15/260–263; 100/122–124; 68/242; 242/532.6, 587, 587.1, 587.2

[56] References Cited

U.S. PATENT DOCUMENTS

| | | | |
|---|---|---|---|
| 224,715 | 2/1880 | Needham | 242/587.1 |
| 493,340 | 3/1893 | Prescott | 15/262 |
| 605,362 | 6/1898 | Trimble | 15/262 |
| 612,116 | 10/1898 | Marquis | 15/262 |
| 612,842 | 10/1898 | Griffith | 15/262 |
| 634,901 | 10/1899 | Munnig | 100/122 |
| 736,065 | 8/1903 | Burnham | 15/262 |
| 824,592 | 6/1906 | Morgan | 100/123 X |
| 1,004,295 | 9/1911 | Morgan | 100/122 X |
| 1,053,838 | 2/1913 | Livingood | 100/123 |
| 1,569,360 | 1/1926 | Edwards | 15/104.04 |
| 1,605,330 | 11/1926 | Dorroh | 68/96 |
| 2,061,556 | 11/1936 | Blake | 15/262 |
| 2,099,217 | 11/1937 | Newland | 15/262 |
| 2,350,152 | 5/1944 | Dahlstrom | 100/123 X |
| 3,346,906 | 10/1967 | Harrison et al. | 15/262 |
| 3,707,740 | 1/1973 | Demers | 15/236.03 |
| 3,916,470 | 11/1975 | May | 15/98 |
| 4,428,099 | 1/1984 | Richmond | 242/587.1 X |
| 5,090,084 | 2/1992 | De Guzman | 15/230.11 |
| 5,440,778 | 8/1995 | De Guzman | 15/260 |

FOREIGN PATENT DOCUMENTS

| | | |
|---|---|---|
| 225832 | 1/1969 | U.S.S.R. . |
| 2990 | 2/1968 | United Kingdom . |

*Primary Examiner*—Mark Spisich
*Attorney, Agent, or Firm*—Henricks, Slavin & Holms LLP

[57] ABSTRACT

An adjustable wringer can wring a variety of different types and sizes of mops, wipes, sponges and other wringable items for use in cleaning clean rooms. The wringer has two side plates situated in a spaced relationship relative to one another, each of the side plates having a slot. The wringer has a lever which has a handle and a rod. The handle has side posts, with the lower end of each side post being rotatably mounted to a respective side plate, and a handle bar extending across and connecting the upper ends of the first and second side posts. The rod is attached at each end to a handle side post, with each end of the rod passing through a respective slot in the side plates. The wringer also has a crank which has a crank handle and a rotatable crank shaft that extends from one side plate to the other. A substantially lint-free, flexible web is supported at one end by the rod and at the other end by the crank shaft. The web may be held in the crank shaft by extending tongues on the web into slots on the crank shaft and wrapping the web about the crankshaft once or twice. Once a wringable item has been placed in the wringer, the rod may be moved next to the crankshaft. The crank handle may then be rotated to tighten the flexible web about the wringable item, thereby wringing the item. The wringer may additionally include low-friction bushings to replace the lubricating oils and greases typically found in wringers, thereby making the wringer suitable for sterilization in an autoclave.

14 Claims, 11 Drawing Sheets

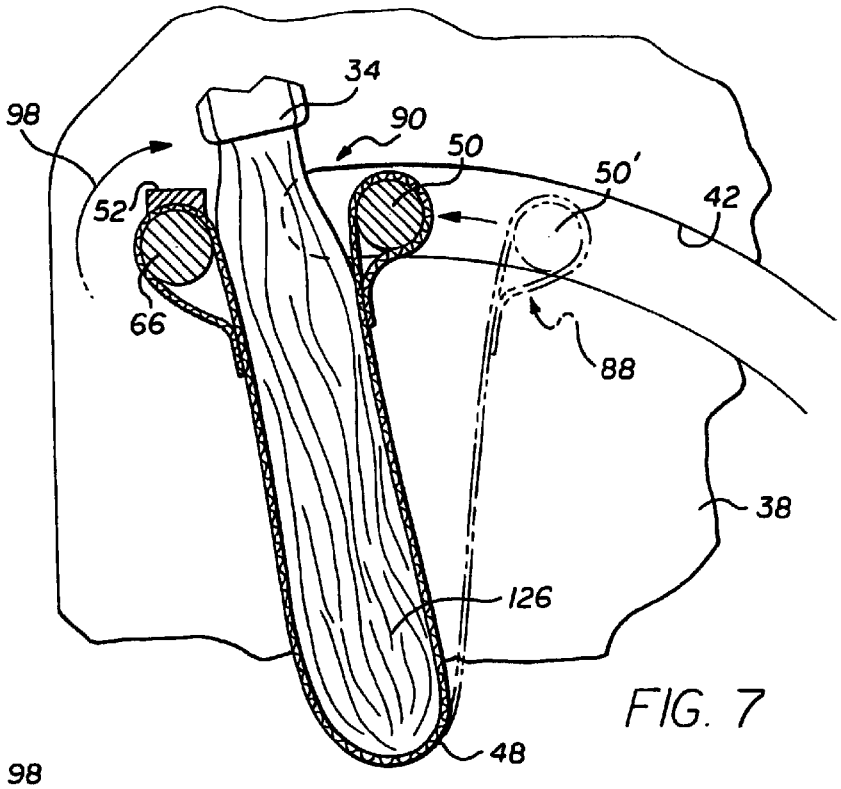
FIG. 7
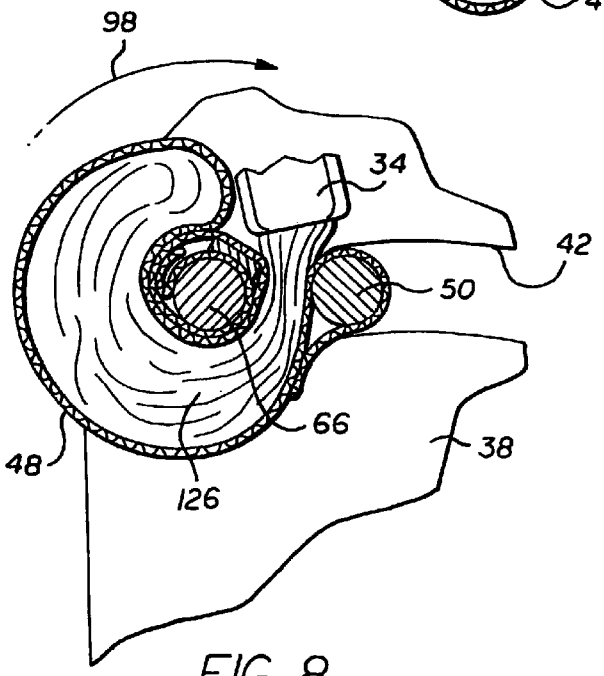
FIG. 8
FIG. 9
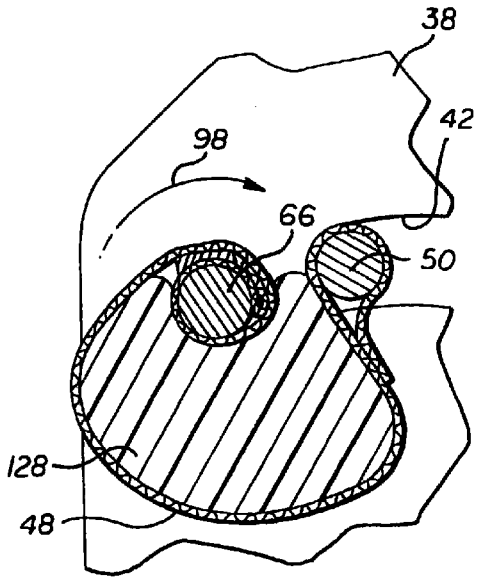

WRINGER, WEB SUPPORT AND WEB

BACKGROUND OF THE INVENTION

A. Field Of The Invention

The present invention relates to wringers for use in clean rooms, and particularly to a versatile, wringer that can wring a variety of types and sizes of mops, wipes, sponges and other wringable materials without use of lubricating oils and greases.

B. Related Art

Certain pharmaceuticals, electronics and other specialized goods must be manufactured in contamination-free "clean rooms" which are kept free from impurities such as dust and microorganisms. Similarly, hospitals maintain their operating rooms as "clean rooms" in which all reusable items are sterilized in high-heat autoclaves prior to reuse.

As a usual aspect of maintaining the contamination-free environment of a clean room, a cleaning crew typically comes through on a regular basis with a bucket of cleaning solution, a mop, a wringer and sponges. The crew mops up the entire floor, wringing the mop with the wringer whenever it gets dirty. Sponges are usually squeezed out into the bucket of cleaning solution.

It should be noted that the most common type of wringer is the downward gear press wringer. The wringer uses levers, gears and springs to move two parallel bars downward, thereby applying a downward force on the mop head. The mop is supported from below by a perforated pan. However, there are several drawbacks associated with using this mop in a clean room environment.

To begin with, the typical wringer cannot be sterilized in an autoclave. The moving parts of the wringer are normally coated with grease or oil to reduce friction. In the high heat of an autoclave, the grease and/or oil flows very easily and drips onto the autoclave. The wringer then must be re-lubricated before it can be used again.

Grease and oil are problematic in other ways, such as getting into the cleaning solution and eventually onto the floor and walls of the clean room. Unfortunately, to do away with the lubricant allows moving metal parts such as shafts to directly contact adjoining metal surfaces, creating metal particles which drop down into the cleaning solution.

Aside from introducing new contaminants into the clean room, these wringers have other operational difficulties. First, the normal wringer is not versatile. It is designed for a certain type and size of mop, and cannot accept other shapes and sizes of mops. So, for instance, a large, square sponge mop may not fit into a wringer designed for a small string mops. Even when a wringer accepts more than one type of mop, its water-extracting performance is generally much better for one type of mop than another.

Second, a wringer will generally not apply even wringing pressure to wringable items. For instance, a downward gear press wringer will typically apply substantial pressure to limited areas of the mop, but not apply any pressure to other areas. Consequently, the wringer does not wring water from certain portions of the mop.

Third, typical wringers are difficult to clean. Dirt particles get caught in the cracks and corners of the assembly, which must then be hosed down. If the wringer is not regularly cleaned, accumulating dust and dirt fall down into the cleaning solution and work their way back onto surfaces of the clean room.

Additionally, most wringers have a minimum item size because the gear press will only travel so far. Accordingly, the wringers will not clean small wipes or sponges.

SUMMARY OF THE INVENTION

Broadly considered, an adjustable wringer in accordance with the present invention may wring a variety of different types and sizes of mops, wipes, sponges and other wringable items. The wringer may have a wringer frame having a first member and a second member for supporting a flexible web. One end of the flexible web may may be supported by the first member, and another end of the web may be supported by the second member. The wringer may have a first mode in which a wringable item may be loaded onto the surface of the flexible web in between the first member and the second member. The wringer may also have a second mode in which the flexible web substantially envelopes and applies substantially uniform pressure to at least a major portion of the wringable item.

The flexible web preferably conforms to the shape of the wringable item, thereby accommodating a variety of types, shapes and sizes of wringable items. By conforming to the shape of the item, the flexible web evenly distributes wringing pressure over the item, thereby wringing a higher volume of water than conventional wringers.

The present invention is generally easy to clean and maintain. At least some embodiments of the present invention have no bottom other than the flexible web, which is easy to remove and replace.

The present invention may use Teflon-coated bushings and/or other parts and there is no oil or grease to contaminate the cleaning solution. There is also no metal-to-metal contact to create contaminating particles.

In a preferred form of the inventions, the flexible web can be more easily installed on the wringer assembly without having to remove fasteners, holding elements or the like. In one form of the invention, the wringer assembly includes a web support element having a discontinuous surface for releasably engaging part of the flexible web. With the discontinuous surface, the web can engage the web support element and then can be wrapped around the web support element in a manner that still allows the web to be removed if desired. When the web is wrapped around the support, the flexible web tightens around the support and the underlying web material, and is thereby supported by and held on the web support element. The discontinuous surface on the web support element can be grooves on the surface, apertures through the web support element from one side to another, slots or the like.

In the preferred embodiment, the web support element is a support rod rotatably supported on a frame or other support and the discontinuous starface on the rod is formed as a plurality of longitudinally extending slots passing along a diameter of the rod from one side of the rod to another. Preferably, the web support rod includes three similarly sized slots for accepting similarly sized tongues on a flexible web. The rod may be supported for rotation in the wringer assembly through bushings or sleeves in spaced-apart frame walls of the wringer assembly.

The flexible web may take a number of different configurations in the preferred embodiment, but it is preferably complimentary with the supporting rod, which supports it through one or more of the discontinuous surfaces in combination with any wraps made about the rod. In the example of a rod having three slots, the flexible web preferably includes a plurality of tongues corresponding to the number of slots in the support rod. Preferably, the flexible web is sized sufficiently to allow the web to drape or extend down into a supporting bucket or other receptacle when the flexible web is slack. The web is also made sufficiently long so that each of two opposite ends of the web can include identical sets of tongues which will overlap when the web is doubled back on itself around another support element such as a second rod. Specifically, the flexible web is folded at an approximate midpoint so that the opposite ends having respective tongues are overlying each other, and the fold is placed about the second web support rod. The overlapping tongues are then inserted into respective slots in the slotted rod, and the support rod rotated so as to wrap the web around the slotted rod several times. The windings then hold the flexible web in place on the slotted rod.

With this method of mounting the flexible web, a new flexible web can be easily mounted on the wringer assembly, and removed when necessary, such as for cleaning, drying or the like. Replacement webs are also easily installed, without having to remove hardware.

In a further form of the invention, the flexible web can be supported by two rods or other supports, one of which is movable by operation of a handle to be closer or further away from the other rod. In the preferred embodiment, the handle is relatively short so as to minimize the amount of movement necessary to bring the opposite support rods closer to each other. Additionally, the top surfaces of the spaced apart plates supporting the web support rods is curved, radiused or otherwise made convex so as to permit free and unobstructed movement of the handle.

It may be noted that numerous variations in the above-described embodiments are possible. For instance, the crank shaft may be fixed on the frame. Alternatively, the bar may be fixed on the frame while the crank shaft is free to move relative to the bar. As yet another alternative, both the crank shaft and the bar may be free to move relative to one another. A handle may be attached to the sliding member or members for user convenience.

Other features and advantages of the invention will become apparent from a consideration of the following detailed description and the accompanying drawings.

BRIEF DESCRIPTION OF THE DRAWINGS

FIG. 7 is a sectional view showing the head of a string mop inserted into the freely-hanging web of the embodiment of FIG. 1;

FIG. 8 is a view of the section of FIG. 7 with the wet) and the mop strings wrapping about the crank shaft;

FIG. 9 is a cross-sectional view showing the wringer of FIG. 1 wringing a sponge;

DETAILED DESCRIPTION OF THE PREFERRED EMBODIMENTS

Figure 1:
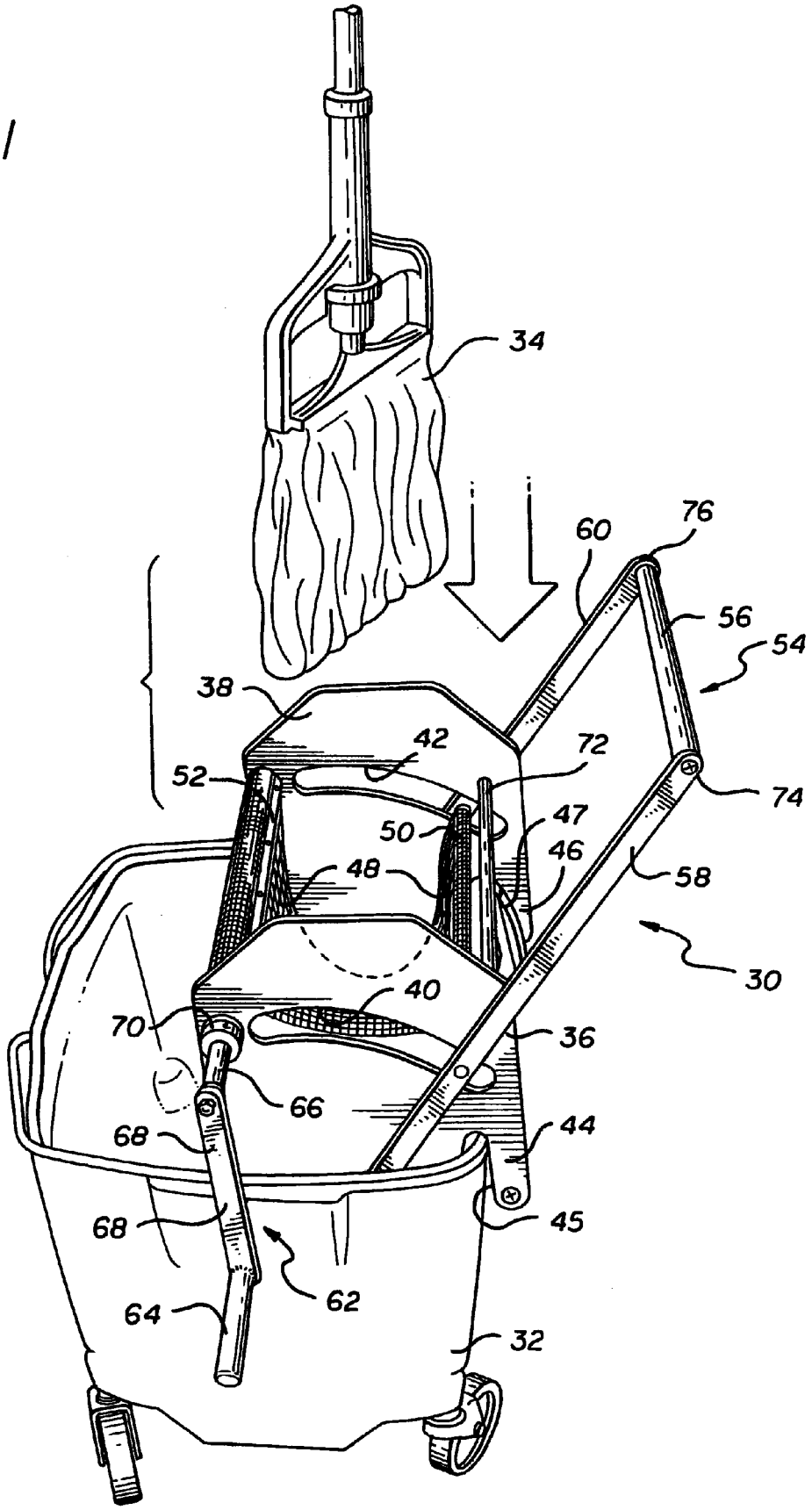
FIG. 1 is a front perspective view of a preferred embodiment of a wringer in an open position ready to receive a wringable item.

A presently preferred embodiment of a multiple purpose wringer 30 is illustrated in FIGS. 1–9. FIG. 1 shows multi-wringer 30 mounted on a bucket 32. The multi-wringer 30 is in an open position and is ready to receive a mop 34. The multi-wringer has first and second stainless steel side plates 36, 38 which have side plate sots 40, 42 and first and second bucket mounts 44, 46. An important feature of multi-wringer 30 is a lint-free, flexible polyester web 40 which is looped on one end about slicing rod 50 and which is clamped on its other end to crank shaft 66 by clamp bar 52. In the open position of FIG. 1, the opposing ends of flexible polyester web 40 are spread a distance apart, allowing the rest of the web 40 to hand loosely in a concave shape. It may be noted that in the open position of FIG. 1, there is a wide, substantially unobstructed loading space in between crank shaft 66 and sliding rod 50. Consequently, mop 34 may be loaded into the multi-wringer 30 from above.

Sliding rod 50 is connected to lever 54. Specifically, sliding rod 50 is connected at one end to a first lever side post 58 and is connected at its other end to second lever side post 60. In FIG. 1, sliding rod 50 is connected to the side post 58, 60 by screws. Lever 54 also includes a lever handle 56 connected to an interposed in between the upper ends of the lever side post 74, 76. It may be noted that one end portion of sliding rod 50 passes through slot 40 of the first slide plate, while the opposing end of sliding rod 50 passes through slot 42 of the second side plate. First and second lever side posts 58, 60 are situated on the exterior sides of first and second side plates 36, 38.

Multi-wringer 30 also includes a crank unit 62 which includes a crank handle 64 which is welded or otherwise connected to crank connecting bar 68, which in turn is attached to crank shaft 66. the crank shaft 66 passes through apertures in both the first and second side plates 36, 38 (apertures not shown). Crank 62 includes a stainless steel collar 70 through which crank shaft 66 passes, and a glass-filled Teflon bushing 78 interposed in between stainless steel collar 70 and stainless steel first side plate 36. The purpose of glass filled Teflon bushing 78, and its counterpart (not shown) on the exter or side of stainless steel second side plate 38 is to provide low-friction support for crank shaft 66. These Teflon bushings take the place of lubricating greases and oils that are found in conventional wringers. The stainless and Teflon construction of wringer 30 are well suited for the high heat environment of the autoclaves that are typically used to decontaminate items prior to reuse in a clean-room.

Figure 2:
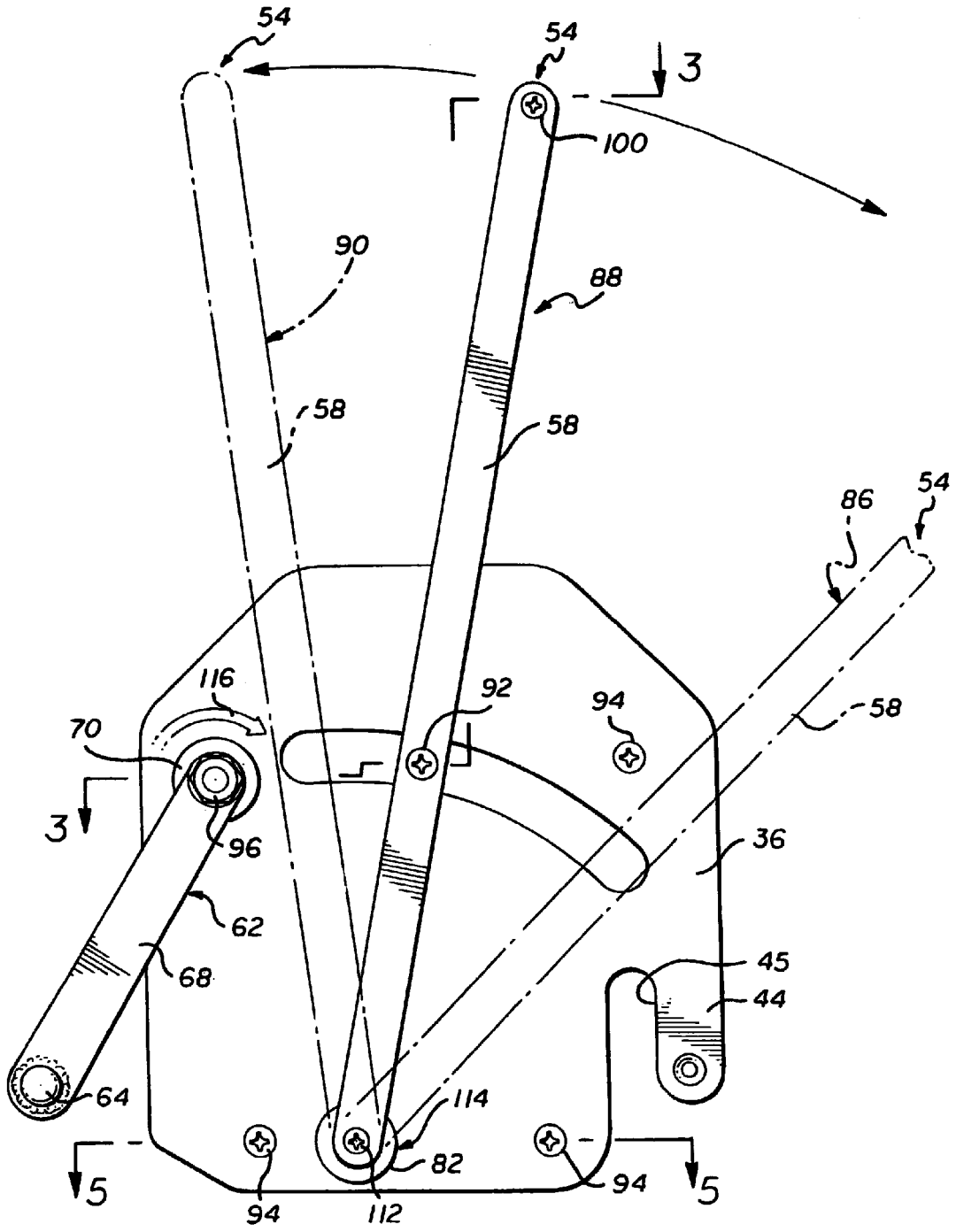
FIG. 2 is a side view of the wringer of FIG. 1.

FIG. 2 shows how the lever and sliding rods slide during operation of multi-wringer 30. The wringer has a fully open position 86 in which the lever 54 is spaced a significant distance from crank shaft 66. The lever 54 pivots about lever pivot point 114, so that lever 54 may be rotated to a partially open position 88. Sliding rod 50 (FIG. 1) slides along side plate slots 40, 42. Lever 54 can continue sliding forward to the closed position 90, which may also be referred to as a wringing position. In this closed position 90, sliding rod 50 is substantially adjacent to crank shaft 66. However, if a fairly thick item such as mop 34 is inserted into the hanging flexible web 40 and extends above both sliding rod 50 and crank shaft 66, the sliding rod and crank shaft may be spaced somewhat apart from each other even in the closed position 90, as illustrated in FIG. 7.

Returning to FIG. 2 crank 62 is rotationally mounted on side plates 36, 38 for clockwise rotation, as indicated by indicia 116 printed on the side of the first side plate 36. As will be explained in more detail below, rotating crank handle 64 wraps the flexible web 40 about the crank shaft 66, thereby drawing the flexible web 40 upward and tightly about a wringable item when the multi-wringer is in the closed position 90.

Figure 3:
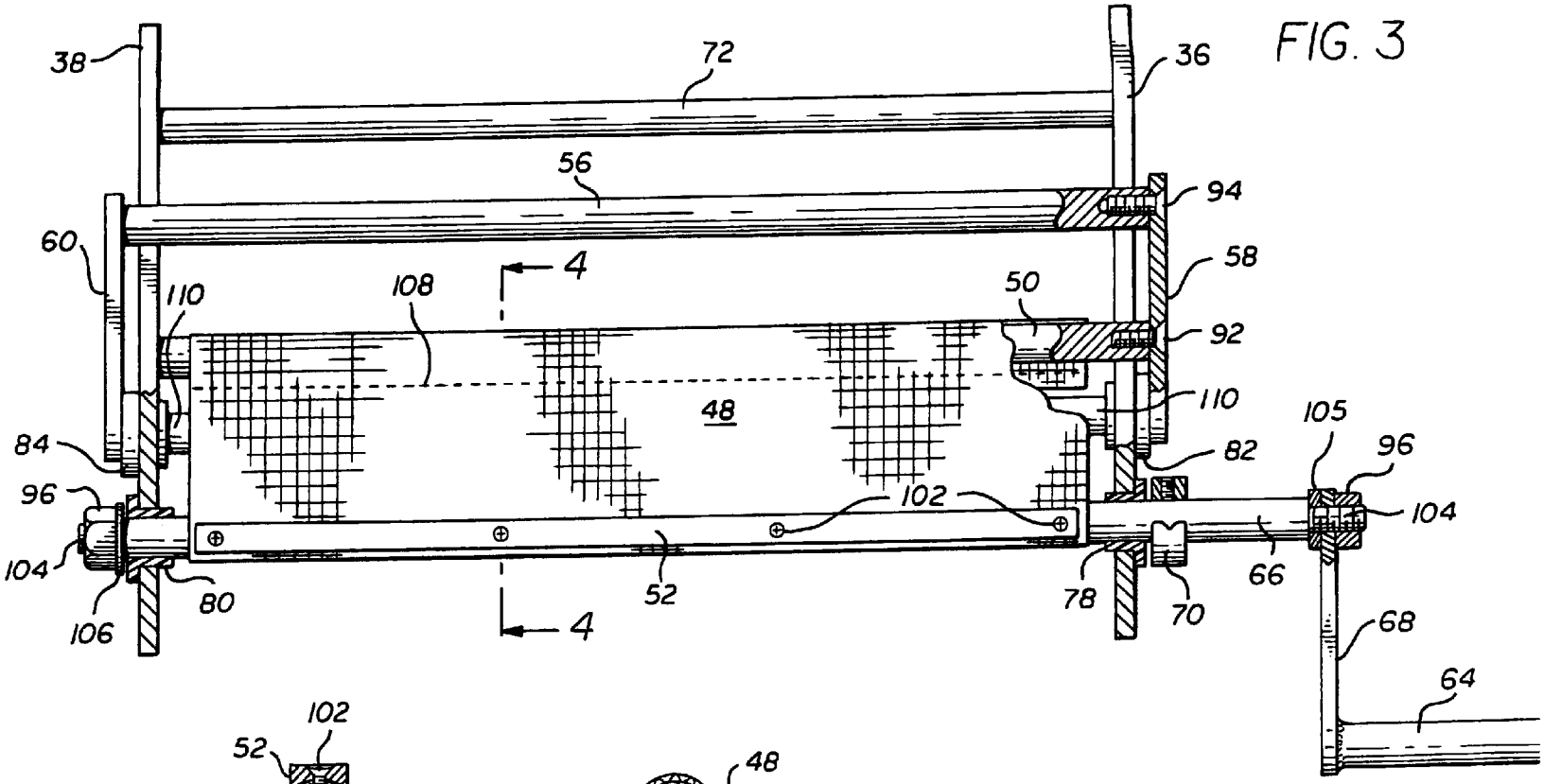
FIG. 3 is a top and partial cross-sectional view looking down along Section 3—3 of FIG. 2.
Figure 5:
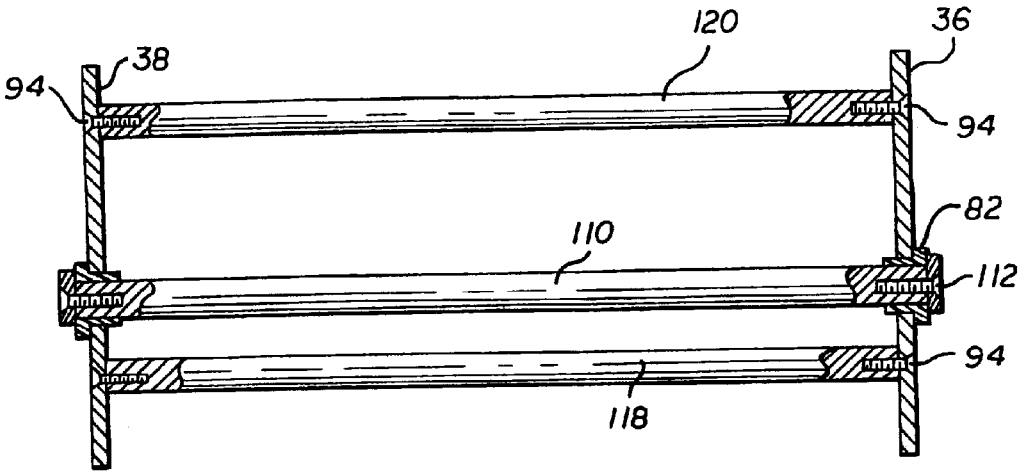
FIG. 5 is a view taken along Section 5—5 of FIG. 2.

The multi-wringer 30 includes various spacer rods, as can be seen in FIGS. 3 and 5. FIG. 3 is a top view looking down along line 3—3 of FIG. 2. Spacer rod 72 is seen interposed in between and connected to side plates 36, 38. Also seen is lever handle 56, which is interposed in between the lever side post 58, 60. The side posts 58, 60 are connected at their lower ends to a rotating lever bar 110, which extends in between and through side plates 36, 38. Rotating lever bar 110 is supported on either end by glass-filled Teflon bushings 82, 84, and is connected at either end to lever side posts 58, 60 by screws 112, as seen in FIG. 5.

Figure 4:
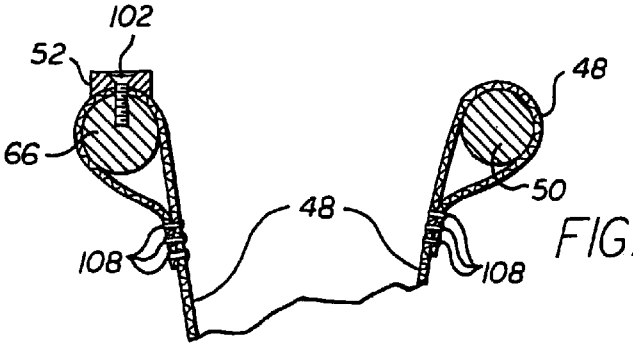
FIG. 4 is a sectional view across the web, the sliding bar, and the crank shaft showing how the web is connected to the sliding bar and the crank shaft.

Rotating crank shaft 66 is also supported by glass-filled Teflon bushings 78, 80, and includes a threaded end 104 for accommodating crank shaft nuts 96 on either end A stainless steel collar 70 prevents lateral movement of the crank shaft 66. Web 40 is fixably attached at one end to crank shaft 66 by means of clamp bar 52 and clamp) bar screws 102 which extend through apertures in clamp bar 52, through web 40 and into threaded screw shafts in crank shaft 66, as seen in FIG. 4. The web 40 may be looped around crank shaft 66, with the loop being closed by means of stitch lines and/or high strength glue. Web 40 is also looped about sliding rod 50, as seen in FIG. 4. The loop may be closed by a stitch line 108 (FIG. 3). It may be noted that Web 40 is looped about sliding rod 50 while, it is fixedly attached to crank shaft 66 because it is intended that web 40 will roll up onto crank shaft 66 as user rotates crank handle 64.

Stainless steel first and second side plates 36, 38 are held in a spaced, substantially parallel relationship by upper spacer rod 72 and front and rear lower spacer rods 118 and 120. These rods include threaded bolt shafts on either end to receive bolts 94, which connect the spacer rods at either end to first and second side plates 36, 38.

Figure 6:
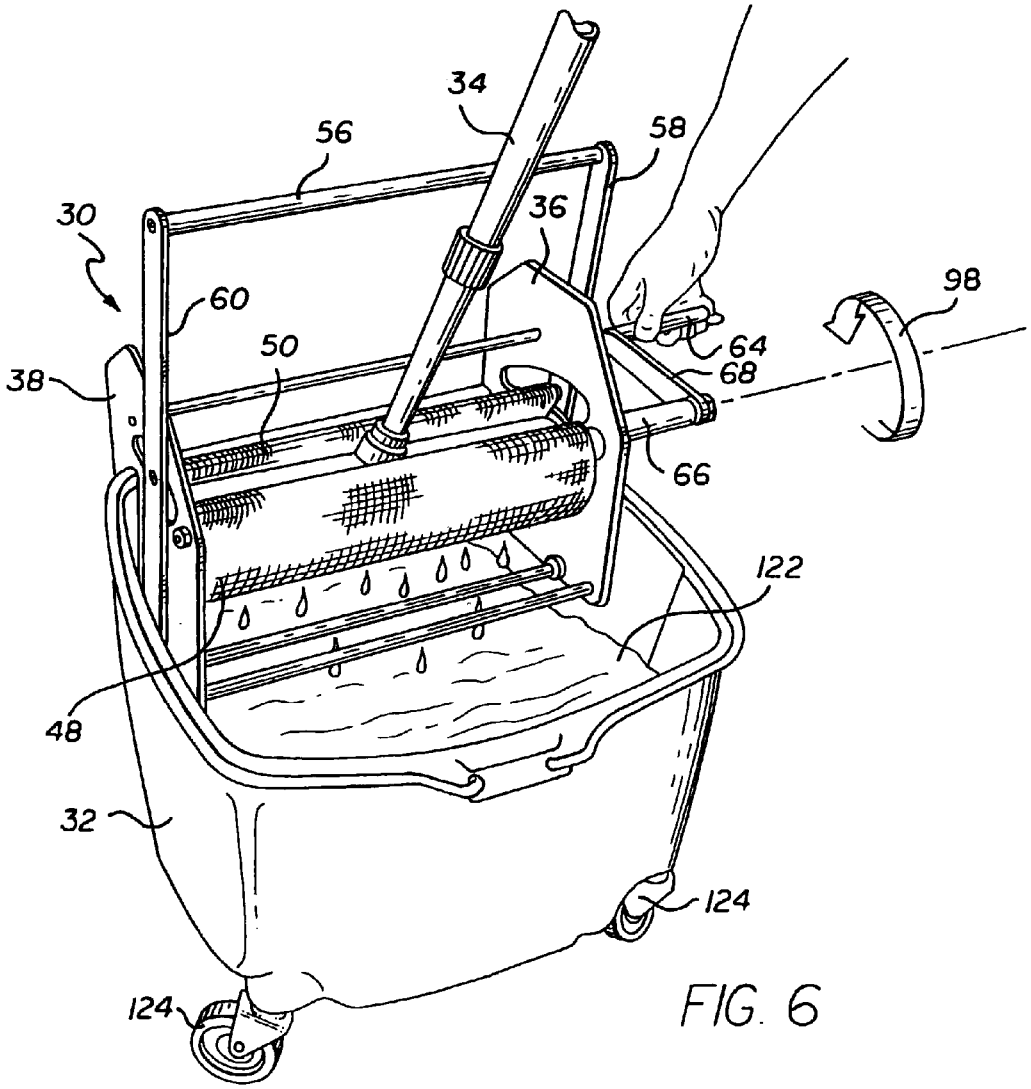
FIG. 6 is a front perspective view showing the wringer of FIG. 1 in a closed position and wringing the head of a string mop.

FIGS. 6–9 illustrate ways in which the multi-wringer 30 wrings a wringable item. FIGS. 6–8 illustrate the multi-wringer 30 wringing the strings of a sting mop 34. To wring the mop 34, the user puts the mop down into the freely hanging web 48 when the sliding bar 50 is in a fully or partially open position. In FIG. 7, the sliding bar in a partially open position 88 is represented by Reference numeral 50 with a prime symbol above it and is drawn in a broken line. Once the head of the mop 34 is inserted into the concave shaped region defined by the freely hanging web 48, the user slides sliding bar 50 into a closed position 90 by pulling on lever handle bar 56. FIG. 7 shows sliding rod 50 having been slid into the closed position 90. The user then rotates the crank handle 64 in a clockwise direction, as shown in FIG. 6. The web 48 responds by rotating about crank shaft 66 along with the strings of the mop 126. As the web 48 is drawn around crank shaft 66, it pulls tight against mop strings 126, applying a substantially uniform wringing pressure to at least a major part of the mop strings 126. Water and dust and dirt particles are then squeezed out of mop strings 126 and through the web 48 down into the reservoir of cleaning solution 122 stored in bucket 32, as FIG. 6 shows. It may be noted that the web 48 may rotate a greater or lesser degree about crank shaft 66 depending upon the size and shape of the wringable item which is placed in the wringer. So, for example, a very large bundle of strings from a string mop might make one or fewer complete rotations about the crank shaft 66, whereas a relative thinner string mop may make two or more complete revolutions about crank shaft 66, with different layers of strings 126 wrapping about each other in layers.

FIG. 9 illustrates a situation in which a sponge 128 has been placed in the multi-wringer 30. In this case, as the user continues to crank handle 64 in a clockwise direction, the sponge 128 will rotate as a whole up and over crank shaft 66. Depending on the size of sponge 128, the sponge may even continue rotating back down in between crank shaft 66 and sliding rod 50. The end result is that the web 48 will have been drawn very tightly about sponge 128, thereby applying a strong and substantially uniform wringing pressure about at least a major portion of the sponge 128 and thoroughly wringing the sponge of cleaning solution.

To remove an object from the wringer 30 after it has been thoroughly wrung, the user may rotate the handle 64 in a counter clockwise direction to return the web to its initially closed position 90 as shown in FIG. 7. The user may then slide the sliding bar 50 into the partially open position 88 or the filly open position 86 by pulling on lever handle 56 to rotate lever side bars 58 and 60 out of the closed position. The user can then remove the wringable object, such as mop 34, from the multi-wringer. It may be noted that a wide variety of different wringable items may be wrung in the multi-wringer 30, such as sponges, mop heads of various heads and sizes, wipes, rags and even wet clothing, such as sweaters that have been washed by hand. Consequently, multi-wringer 30 is truly a multiple-purposewringer in that it can wring dry a wide variety of wringable items and for a wide variety of purposes, both in clean rooms and in other cleaning applications.

Figure 10:
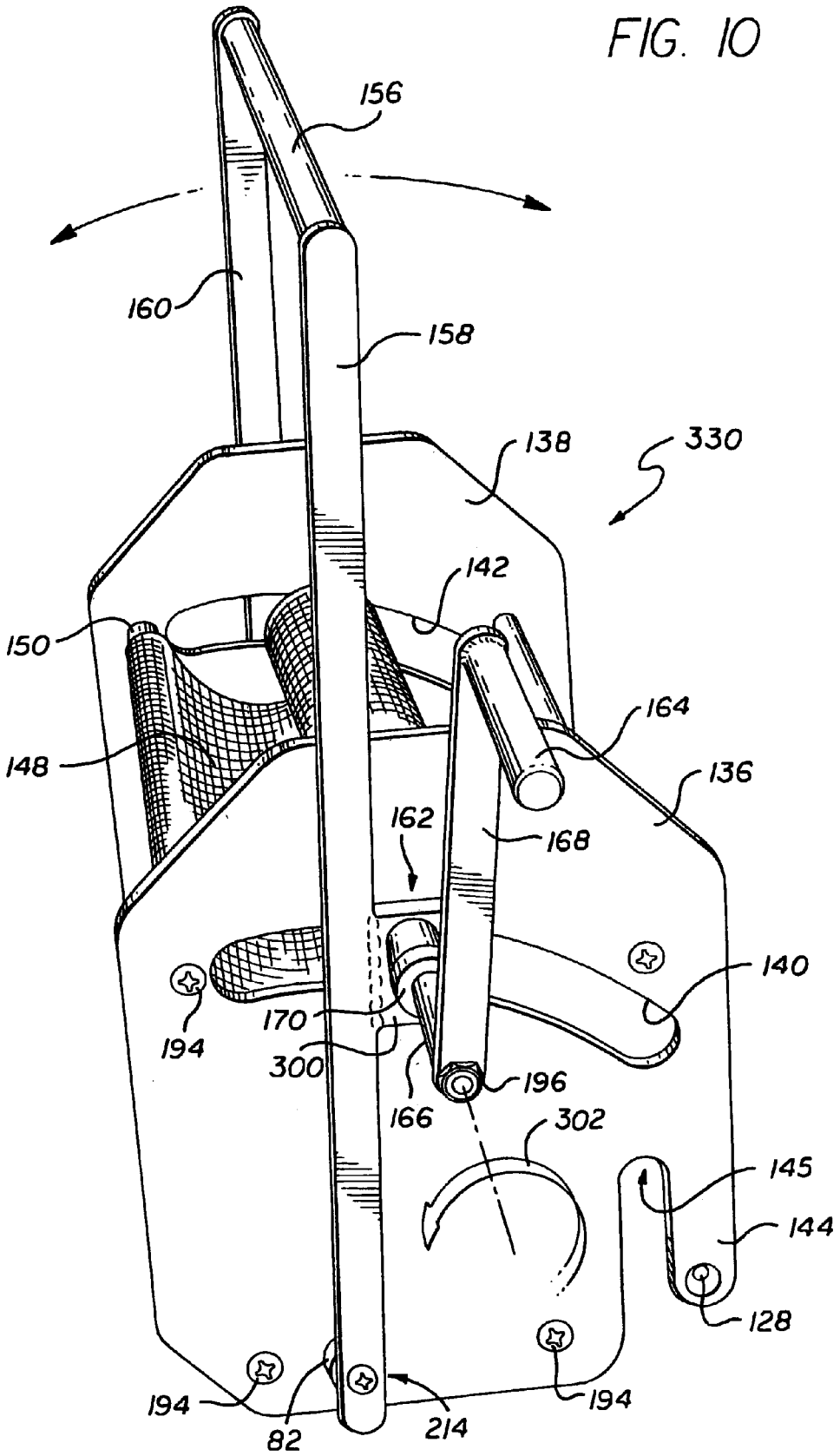
FIG. 10 is a perspective view of an alternative embodiment of the present invention in which the crank slides.
Figure 11:
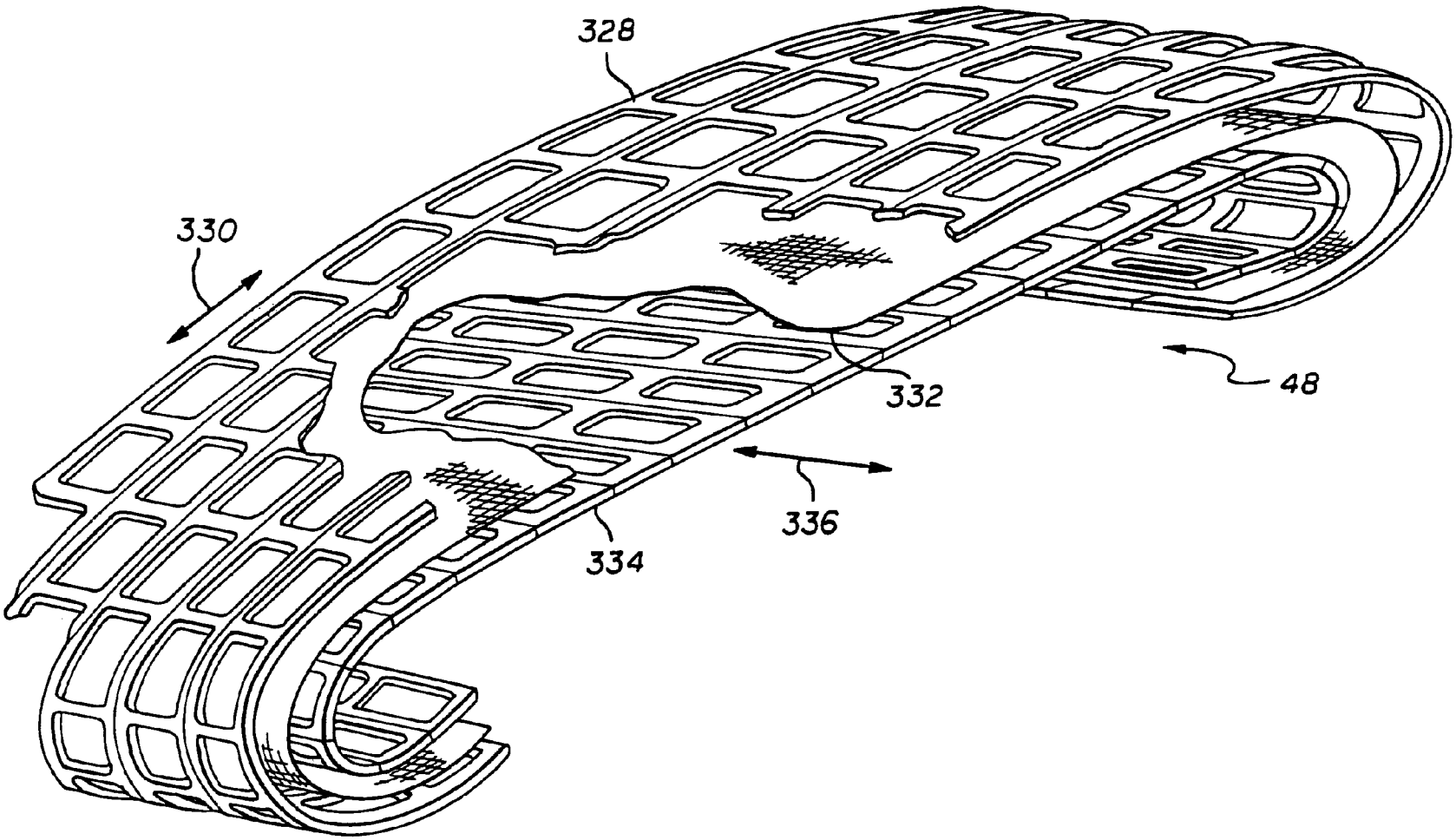
FIG. 11 is a perspective and partial cutaway view of an exemplary web for use with one or more forms of the present inventions.

FIG. 10 illustrates an alternative embodiment of the multi-wringer 330 in which the crank 162 slides along the slots 140, 142 and in which the rod 150 is fixed relative to the wringer frame. The reference numerals of FIG. 10 generally correspond to the reference numerals used previously with the addition of a 1, 2 or 3 in front of the previously used reference numeral. In this embodiment, the crank shaft 166 extends through an aperture (not shown) in an extension piece 300 which extends from lever side post 158. Crank shaft 166 extends through first side plate slot 140, then across the space defined by the side plates 136, 138, and ultimately through second side plate slot 142. Crank shaft 166 is supported by glass-filled Teflon bushings 78, 80 on the exterior sides of side plates 136, 138. For this embodiment, the proper direction of rotation of crank handle 164 is counter clockwise direction 302. This corresponds to the reversal and orientation between the crank shaft 166 and the fixed rod 150.

It may be noted that the web 40 should be designed to resist permanent stretching after repeated use. One approach is to make a web having three layers of material. The first layer may be a polyester net having a knit openings oriented in a certain direction. The middle layer may be a relatively fine polyester mesh through A which fluids and fine particles of contaminant may easily flow. The third layer may be a polyester net similar to the first layer, with the knit openings having an orientation that is 90 degrees rotated from those of the first layer. The differing orientations of the knit openings helps prevent stretching in both the lateral and longitudinal directions.

It may also be noted that the embodiments described herein provide for easily replacing the web once it has worn out. With reference to FIG. 3, the user may pull crank shaft 66 out of the wringer by first unscrewing the screws 102 and removing nut 96 from the threaded far end of the crankshaft. The user may pull sliding bar 50 free of the wringer after having unscrewed screws 92 from either end of the bar 50. The web then falls free of the wringer. A new web is installed by running the crank shaft 66 and the sliding bar 50 through the respective end loops of the new web. The screws and nut are then rotated into place.

For purposes of illustration, but not of limitation, one embodiment of the present invention may have dimensions as follows. The side plates 36, 38 may be 9 inches wide at center and 11.5 inches high. Slots 40, 42 may be portions of a circle of radius 7 inches centered at the respective lever pivot points. The slots 40, 42 may have front portions which begin in the front portion of the side plates at a distance of 3.625 inches below the top of the side plates. The slots may terminate at the rear portion of the side plates at a distance of 5.375 inches below the top of the side plates. The slots 40, 42 may have a width of 1 inch.

Crank connecting bar 68 may be 7 inches long, 0.75 inches wide and 0.375 deep. Crank handle 64 may be 4 inches long with a 0.625 inch diameter. Lever handle 56 may be 14 inches long with a 0.625 inch diameter. The side posts 58, 60 may have an aperture for pivotal mounting to the side plates, the aperture being centered at a distance of 1 inch from the very end of the lower portion of the side posts. The sliding rod 50 may be attached to the side posts 58, 60 at a distance of 8 inches from the very end of the lower portion of the side posts. Consequently, the sliding rod 50 follows the path of tie slots 40,42 as lever 54 is rotated.

The spacer bars 72, 118, 120 may be 11 inches long and have a diameter of 0.5 inches, with threaded bolt shafts extending in 1 inch from either end. The sliding rod 50 may be 16.5 inches long, with a 0.625 inch diameter and with threads along a 0.625 inch portion at one end. The rotating lever bar 110 may be 11.75 inches long and have a diameter of 0.625 inches, with threaded bolt shafts extending in 1 inch from either end.

The Teflon bushings 78, 80, 82, 84 may be 1 inch long, with a 1 inch exterior diameter at the exterior side of the side plates and a 0.875 inch exterior diameter passing through the side plates.

All of these dimensions are merely examples and may be varied to increase or decrease the maximum wringable item size. For instance, the spacer rods and rotating rods may be made substantially wider so that the wringer may accommodate wide mops. Likewise, the diameters of the various rods may be increased for extra-durability wringers.

As for materials, all of the components described, except for the bushings, may be made of stainless steel numbers 302, 303 or 304. The bushing; may be Dehrin/Teflon or DelrinAF, available from the McMaster Company, although other materials may be used. The bushings may be molded, or may be machined from bars of material.

Figure 12:
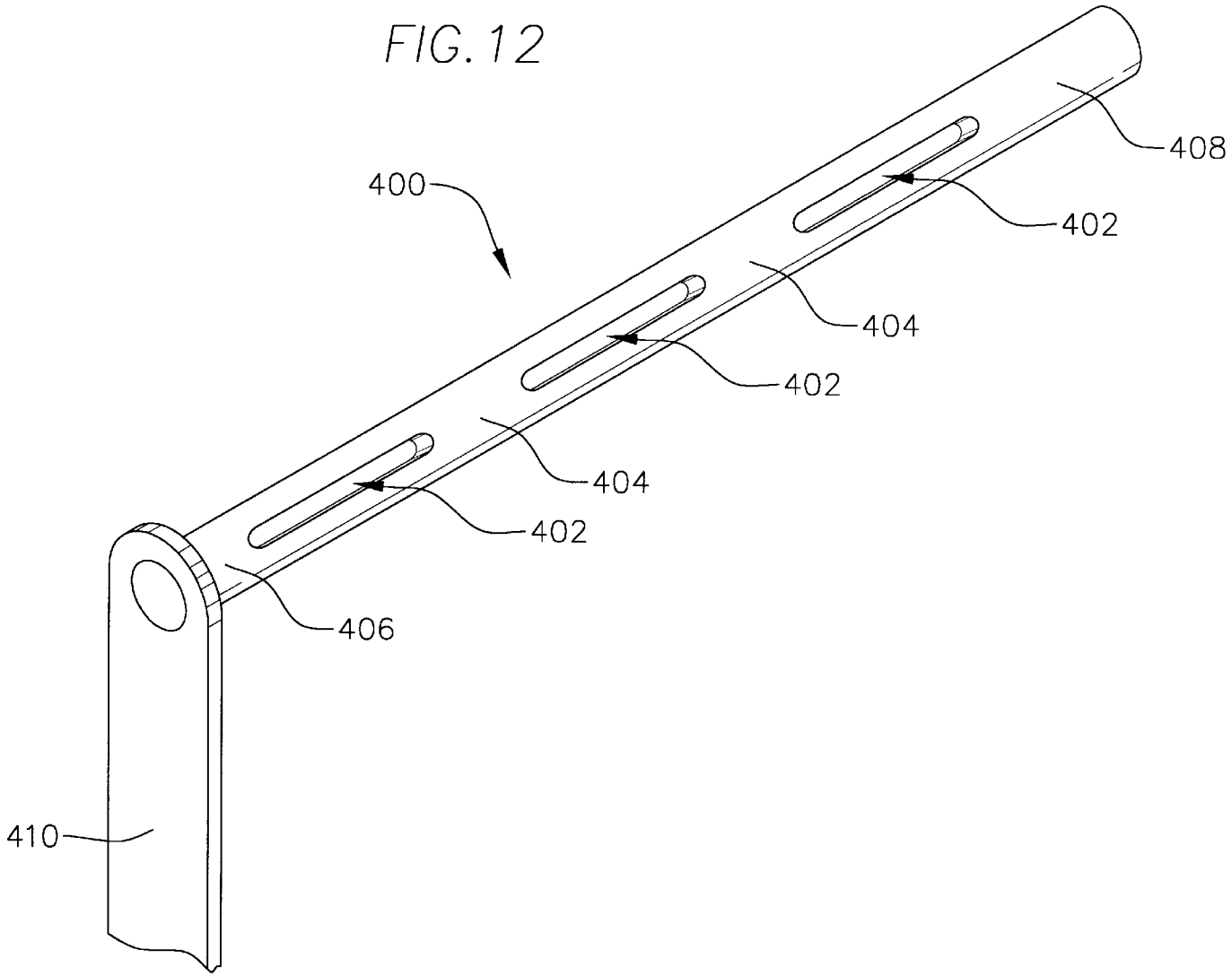
FIG. 12 is a perspective view of a further embodiment of another form of the present inventions showing a slotted rod and part of a crank handle.
Figure 13:
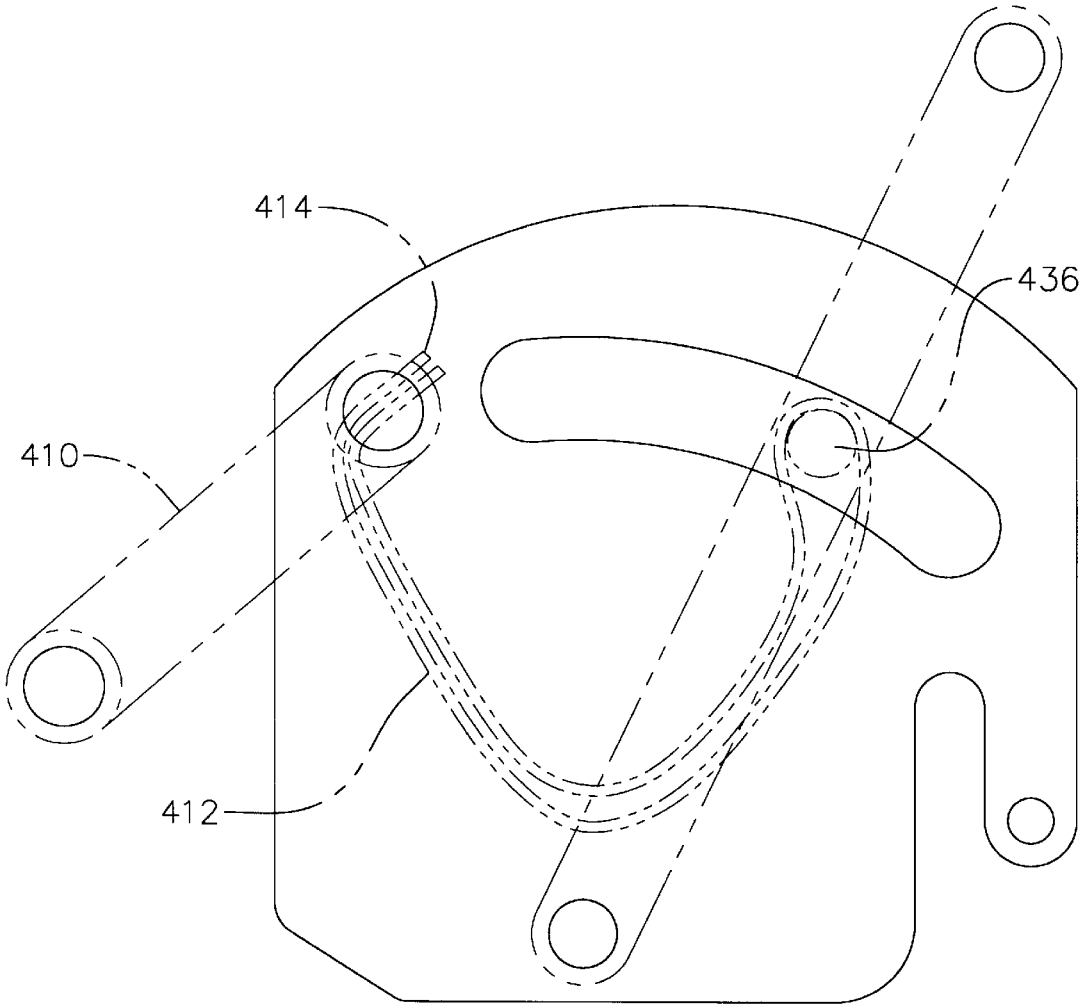
FIG. 13 is a side elevation view of one side of a wringer frame showing in phantom the relative positioning of a web and the support rods of an exemplary wringer according to one aspect of the present inventions.
Figure 15:
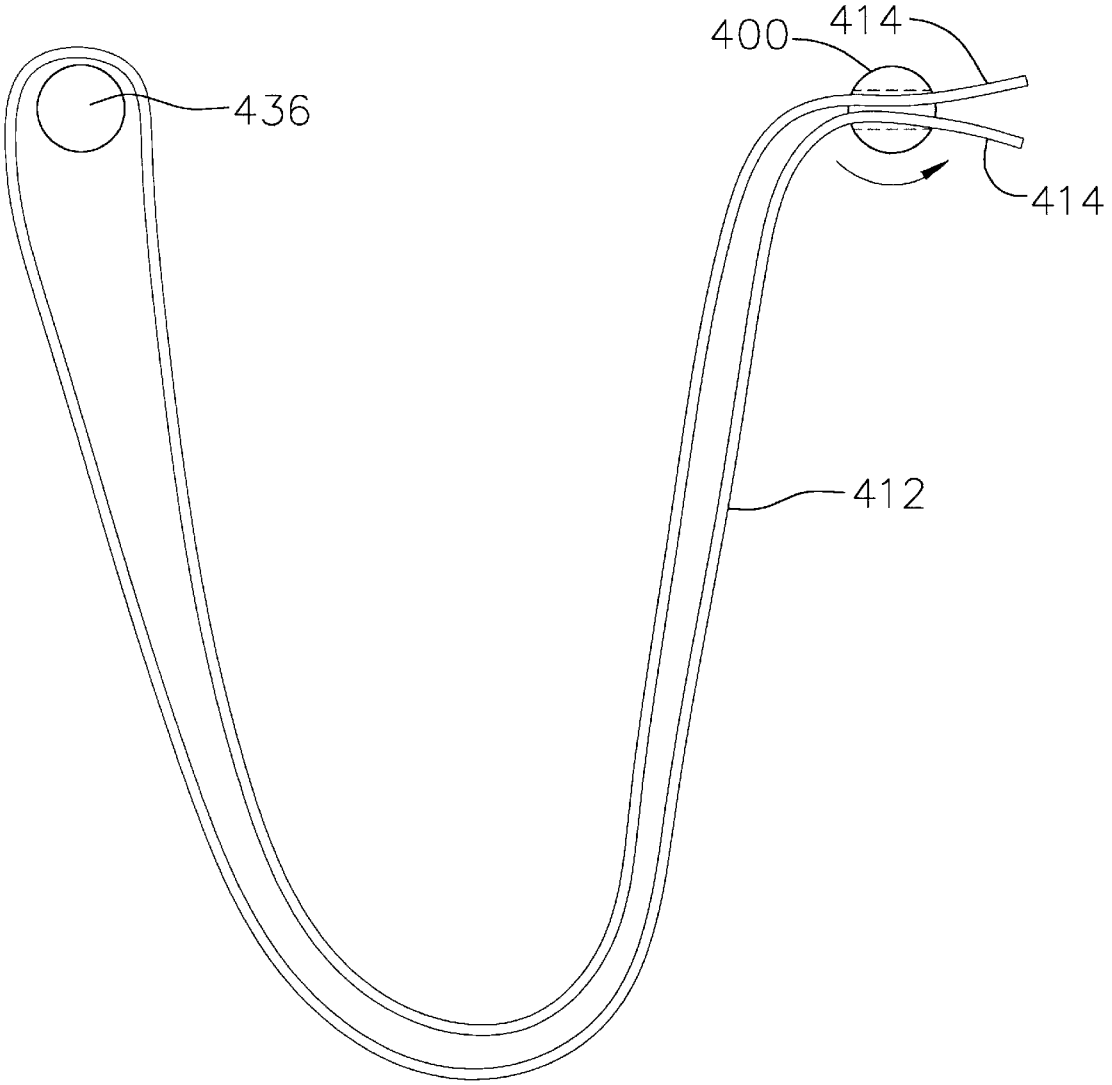
FIG. 15 is a partial schematic and side elevation view of a web and web supports depicting how the web is installed on the web supports for use in a wringer assembly.

In another form of the invention, the wringer includes a web support element 400 (FIGS. 12,13 and 15) which makes it easier to remove and install flexible or other webs or wringing elements. In the preferred embodiment, the support element 400 has a discontinuous surface, preferably in the form of a plurality of longitudinally extending slots 402 passing through the rod 400 along a diameter of the rod from one side of the rod to the other for engaging the web and preferably to hold sufficienty the web in place until one or more wraps can be taken about the support rod to hold the web in place. Preferably, the slots are formned so as to be equal in length and are appropriately spaced relative to each other to accommodate fingers, tongues or panels (discussed below) on the flexible web. The portions 404 of the rod between the slots are preferably solid, as are the ends 406 and 408 of the rod to provide strength and stability to the rod.

The slotted rod ends 406 and 408 pass through and are mounted to the plates of the wringer assembly through openings in the plates which accommodate suitable bushings or other mounting means (similar to what is shown in FIGS. 1–3 and 5) for rotatably supporting the slotted rod in the wringer assembly. The bushings may be mounted on the slotted rod through set screws or other mounting means appropriate under the circumstances. A handle 410 or other means for rotating the slotted rod 400 is mounted to the slotted rod to rotate the slotted rod, thereby tightening or loosening the flexible web in the wringer assembly.

Figure 14:
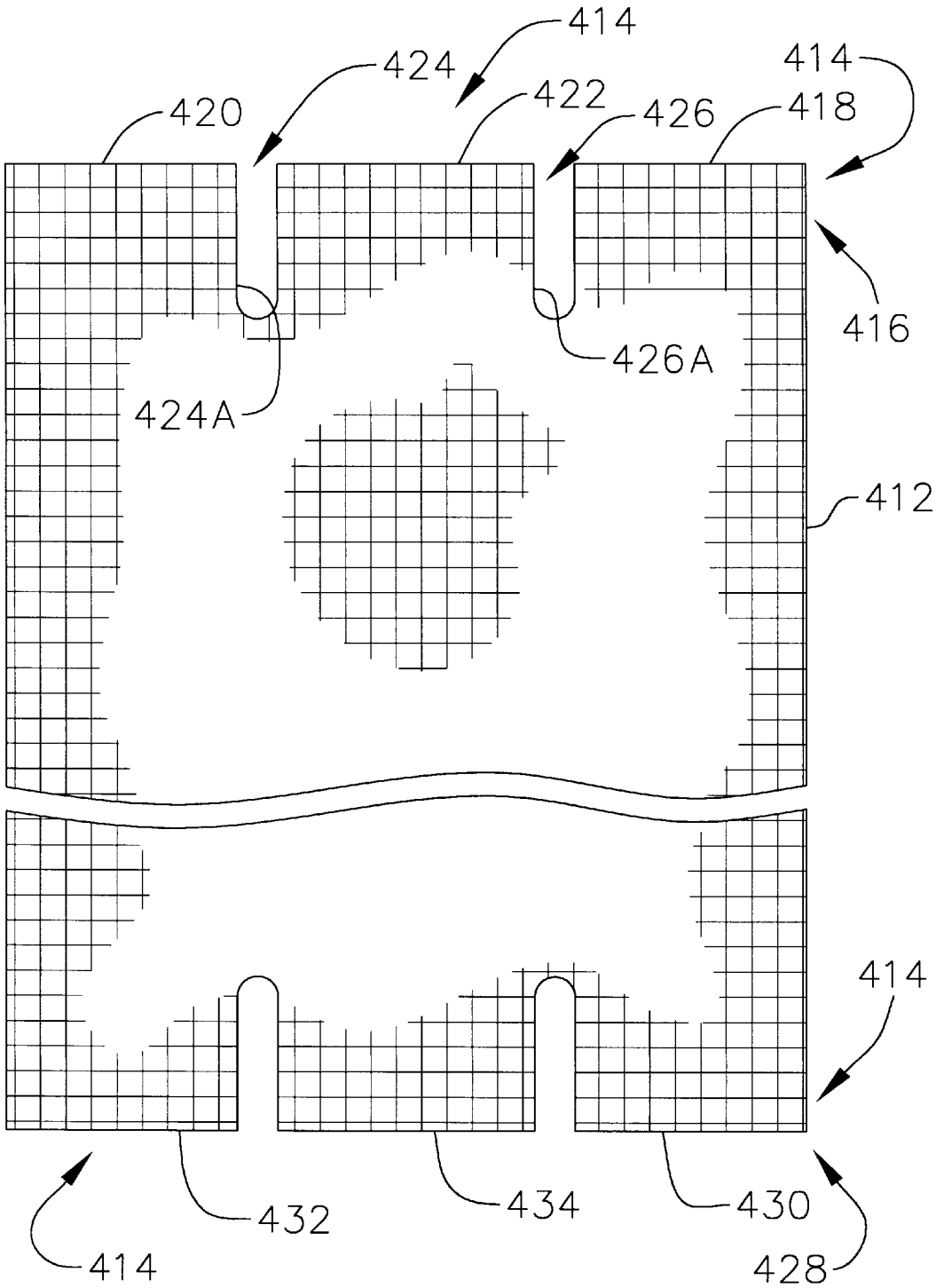
FIG. 14 is plan view of a flexible web for use in accordance with one aspect of the present inventions.

The flexible web 412 (FIGS. 13–15) to be used in this embodiment of the wringer assembly is preferably formed from more than a double length of flexible web which can be doubled back on itself to form the desired length of the web for the wringer. The extra length of the flexible web 412 beyond that which is used for wringing (as depicted in FIGS. 1–10) is used to provide for a plurality of web tongues 414 on oppositely facing ends of the flexible web. The web tongues 414 on each end of the flexible web preferably are each dimensioned so as to pass through the corresponding slots on the slotted rod relatively easily but with sufficient friction to prevent the tongues from coming out of the slots solely by the weight of web. The amount of friction between the web and the slots depends on a number of factors such as the web material and the rod material, surface finishes, the web thickness and the slot sizes in the rod.

A first end 416 of the flexible web includes a first outer web end tongue 418 and a second outer web end tongue 420 on opposite sides of the flexible web. A center tongue 422 extends between the first and second outer web end tongues. The first and second outer tongues 418 and 420 and the center tongue 422 are spaced from each other by suitable gaps 424 and 426, defined by respective sides 424A and 426A, to accommodate the solid portions of the rod between the slots. Preferably, the width-wise dimension of each tongue end is identical to that for the other tongues.

The second end 428 of the flexible web is preferably formed identical in shape and dimension to the first end 416, with a first outer web tongue 43Q, a second outer web tongue 432 and a center web tongue 434. The lengths of the tongues are preferably sufficient so as to extend completely through the respective slots in the slotted rod and wrap part way around the slotted rod when the rod is rotated so that the web is held in place by one or more wraps about the rod under normal conditions of use.

During assembly, the flexible web is doubled back on itself and placed about a second web support rod 436, which is positioned approximately in the fold. The oppositely extending web tongues, from opposite ends of the web, are placed against each other so that they overlie each other. The overlying tongues are then passed into the respective slots on the slotted rod until all of the tongues are inserted through the respective slots. The crank or other device is then operated to rotate the slotted rod, and wrap a portion of the flexible web about the slotted rod, thereby holding the flexible web in place. The wringer assembly can then be used in a manner similar to that described above.

After the prescribed number of uses of the flexible web, or once the web is worn out, the web is removed by unwinding the web from the slotted rod and removing the tongues from the slots in the slotted rod. The web is then removed from the opposite support rod and a new flexible web installed. The flexible web can also be removed for cleaning or drying in the same manner.

Other discontinuous surfaces besides the slots can be used on the rotating rod as alternatives. For example, the rod can include sprocket tines or projections extending from the circumferential surface of the rotating rod. These projections can engage the surface, threads or other parts of the flexible web to hold it in place while the end of the web is wrapped around the rotating rod. The discontinuous surface or surfaces may also take the form of cuts or grooves in the circumferential surface of the rotating rod. For example, a cut may be formed at each end of the rod to accept side edges of the web. The cuts will have spacings sufficient to frictionally engage the web and keep it in place against the weight of the web, while still permitting removal from the cuts by manual pulling on the web. While the web is held in place, the rod can be rotated so as to wrap one or two layers of the web about itself and hold the web on the rod. Other configurations are also possible.

It is to be understood that the foregoing detailed description and the accompanying drawings related to preferred embodiments of the invention. Various changes and modifications may be made without departing from the spirit and scope of the invention. Thus, by way of example and not of limitation, the crank shaft may have a clothes-pin configuration having two parallel prongs, a slot in between the prongs, and an open end. The web 40 is looped about the first prong, but not the second, so that when the crank shaft is fully mounted on the wringer, the web 40 is attached to the crank shaft. As the clothes-pin type crankshaft rotates, the second prong causes the web to wrap about the crankshaft.

Various other variations to the preferred embodiment may be employed. One of the bucket clamping systems known in the art may replace or supplement the mount and mount indent system illustrated in FIG. 1. A take-up spool may be mounted on the crank shaft to reduce the number of rotations of the handle required to take up the web. The sliding bar may be moved by means other than lever 54. For instance, levers having only one side post may be employed, as may bars and/or handles extending directly from the sliding bar itself. The unit may even be motorized for electrical movement of the sliding bar or rotation of the crank. Additionally, both the bar and the crank unit may be made to slide, with neither of them fixed in a particular position, in particular embodiments.

The crank connecting bar may be attached to the crank shaft in a variety of ways. For instance, it may be advantageous to provide a male spline on the crank end of the crank shaft, with a mating female spline pattern on the end of the crank connecting bar. The user would then be able to easily change the position of the handle for maximum mechanical advantage in squeezing the wringable item. Thus, if the handle were positioned at three o'clock, but he user wanted to further rotate the handle for additional wringing, the user could take the crank connecting bar off of the crank shaft, rotate the crank handle to three o'clock, then reattach the crank connecting bar in its new position. The user could then push down on the crank handle.

Materials other than stainless steel may be used, so long as the materials do not rust or other was degrade when repeatedly exposed to water and cleaning solution. In embodiments which are to be autoclavable, the materials should be chosen to withstand the high heat and humidity environment of an autoclave.

Although the present inventions have been described in terms of the preferred embodiments above, the described embodiments of the invention are only considered to be preferred and illustrative of the inventive concept; the scope of the invention is not to be limited or restricted to such embodiments. Various and other numerous arrangements and modifications may be devised without departing from the spirit and scope of the inventions. Accordingly, the present invention is not limited to those embodiments precisely shown and described in the specification. It is intended that the scope of the present inventions extends to all such modifications and/or additions and that the scope of the present inventions is limited solely by the claims set forth below.

What is claimed is:

1. A wringer assembly comprising:

a frame;

a web having at least a first end having a first side and a second side defining the sides of the first end of the web and further including a third side between the first and second sides for separating the first end of the web into a plurality of end pieces;

a first web support for supporting the web relative to the frame; and a second web support having a plurality of slots for accepting the end pieces of the first end of the web, and wherein the first and second web supports are positioned relative to each other so as to have at least part of the web extend between the first and second supports and so that the web can receive and at least partially enclose a wringable item.

2. The wringer assembly of claim 1 wherein the second web support is rotatable.

3. The wringer assembly of claim 1 wherein the second web support is a rotatable rod and wherein the plurality of slots comprises at least three slots.

4. A wringer assembly comprising:

a frame;

a web having at least a first end having a first side and a second side defining the sides of the first end of the web and further including a third side between the first and second sides for separating the first end of the web into a plurality of end pieces;

a first web support for supporting the web relative to the frame;

a second web support comprising a rotatable rod having a plurality of slots for accepting the end pieces of the first end of the web; and wherein the web includes a second end having a plurality of end pieces in a number equal to the number of end pieces on the first end of the web and wherein the end pieces on the second end overlie the end pieces on the first end, and wherein the overlying end pieces are inserted into the slots on the rotatable rod.

5. The wringer assembly of claim 4 wherein the rotatable rod is laterally stationary and the first web support is laterally movable.

6. A wringer assembly comprising:

a frame;

a first web support for supporting a web relative to the frame;

a second web support for supporting the web relative to the frame and including a wall defining at least one opening for receiving a portion of the web into the opening;

wherein one of the first and second web supports is movable toward and away from the other of the first and second web supports; and a web having first and second web portions and supported at the first web portion by the first web support and at the second web portion by the second web support such that the web extends between the first and second web supports for receiving a wringable item, and wherein the second web portion includes a strip portion for being received into the opening in the second web support.

7. The wringer assembly of claim 6 wherein the second web support is supported by the frame so as to be rotatable relative to the frame.

8. The wringer assembly of claim 7 wherein the second web support is coupled to a handle for turning the rotatable second web support.

9. The wringer assembly of claim 6 wherein the second web support includes a number of slots and wherein the web includes a number of strip portions engaging respective slots in the second web support and wherein the second web support is rotatable relative to the frame.

10. The wringer assembly of claim 9 wherein the rotatable second web support supports the web such that rotation of the second web support wraps a portion of the web about the second web support.

11. The wringer assembly of claim 6 wherein the strip portion on the web extends through the at least one opening in the second web support.

12. A wringer assembly comprising:

a frame;

a first web support for supporting a web relative to the frame;

a rotatable second web support for supporting the web relative to the frame and including a discontinuous surface for receiving a portion of the web;

wherein one of the first and second web supports is movable toward and away from the other of the first and second web supports; and a web having first and second web portions and supported at the first web portion by the first web support and at the second web portion by the second web support such that the web extends between the first and second web supports for receiving a wringable item, and wherein the second web portion includes a strip portion for engaging the discontinuous surface in the second web support.

13. The wringer assembly of claim 12 wherein the discontinuous surface includes walls defining slots in the second web support and wherein the strip portion has end portions that extend into respective slots and wherein rotation of the second web support presses the end portions of the strip portion against the second web support.

14. The wringer assembly of claim 12 wherein the first web support is laterally movable relative to the second web support.

* * * * *

UNITED STATES PATENT AND TRADEMARK OFFICE

CERTIFICATE OF CORRECTION

PATENT NO. : 6,055,698
DATED : May 2, 2000
INVENTOR(S) : Joselito De Guzman

It is certified that error appears in the above-identified patent and that said Letters Patent is hereby corrected as shown below:

Title page,
After item [56], References Cited,
Line 8, Patent No. 824,592, change "Morgan" to -- Schayer --.

Signed and Sealed this

Sixteenth Day of October, 2001

*Attest:*

Nicholas P. Godici

NICHOLAS P. GODICI
*Acting Director of the United States Patent and Trademark Office*

*Attesting Officer*